US006176522B1

(12) United States Patent
Jackson

(10) Patent No.: US 6,176,522 B1
(45) **Date of Patent: *Jan. 23, 2001**

(54) EMBOSSING OF BANK NOTES OR THE LIKE WITH SECURITY DEVICES

(75) Inventor: Wayne K. Jackson, Reservoir (AU)

(73) Assignee: Securency Pty Ltd, Victoria (AU)

( * ) Notice: Under 35 U.S.C. 154(b), the term of this patent shall be extended for 0 days.

This patent is subject to a terminal disclaimer.

(21) Appl. No.: 09/288,442

(22) Filed: Apr. 8, 1999

Related U.S. Application Data

(63) Continuation-in-part of application No. 08/557,012, filed on Dec. 7, 1995, now Pat. No. 5,915,731.

(30) Foreign Application Priority Data

Jun. 8, 1993 (AU) ..... PL9262/93
Jun. 6, 1994 (WO) ..... PCT/AU94/00302

(51) Int. Cl.[7] ..... B42D 15/00

(52) U.S. Cl. ..... 283/91; 283/57; 283/58; 283/83; 283/94; 283/901; 428/916

(58) Field of Search ..... 283/91, 58, 57, 283/83, 113, 94, 901; 428/916

(56) References Cited

U.S. PATENT DOCUMENTS 4,033,059 * 7/1977 Hutton et al. .
4,304,809 * 12/1981 Moraw et al. .
4,420,515 * 12/1983 Amon et al. .
4,579,754 * 4/1986 Maurer et al. .
5,005,872 * 4/1991 Lass et al. .
5,388,862 * 2/1995 Edwards .
5,722,693 * 3/1998 Wicker ..... 283/67
5,742,411 * 4/1998 Walters ..... 359/2
5,915,731 * 6/1999 Jackson ..... 283/91

FOREIGN PATENT DOCUMENTS

73762174 * 11/1977 (AU) .
32495/84 * 5/1987 (AU) .
2555215 * 5/1977 (DE) .
3308948 * 9/1984 (DE) .
231760 * 1/1986 (DE) .
2275314 * 1/1976 (FR) .
1200021 * 7/1970 (GB) .
1510021 * 5/1978 (GB) .
52-73762 * 11/1977 (JP) .
90/02658 * 3/1990 (WO) .

* cited by examiner

*Primary Examiner*—Stephen F. Gerrity
*Assistant Examiner*—Daniel Phan
(74) *Attorney, Agent, or Firm*—Foley & Lardner

(57) ABSTRACT

A security document or token such as a banknote is provided which has a transparent portion of plastics material which includes a security device. The region surrounding the transparent portion and preferably all the remaining part of the banknote is printed with indicia. The security device includes regions of embossed lines extending at different angles to each other defining different shapes that are visible to a greater or lesser extent upon transmission and reflection of light as the note is tilted, rotated or viewed from different angles relative to the light source. The embossed lines in some of the regions are finer than coarser and deeper and more widely spaced lines in the other regions. The coarser, deeper lines are of such a thickness and width as to be detectable by touch in addition to being visible by the naked eye. There is also provided a method of and apparatus for producing a banknote with a security device in accordance with the invention in which the transparent portion of the note is embossed during an intaglio printing process.

34 Claims, 5 Drawing Sheets

EMBOSSING OF BANK NOTES OR THE LIKE WITH SECURITY DEVICES

CROSS-REFERENCES TO RELATED APPLICATIONS

This application is a continuation-in-part of U.S. Ser. No. 08/557,012, filed Dec. 7, 1995 now U.S. Pat. No. 5,915,731, which is a 371 of PCT/AU94/00302, filed Jun. 6, 1994.

FIELD OF THE INVENTION

This invention relates to security documents or tokens such as bank notes, travellers cheques, bonds, passports, and is particularly concerned with providing bank notes or other security documents or tokens with a low cost security device that has an attractive appearance whilst being difficult to duplicate.

BACKGROUND OF THE INVENTION

Australian Patent No 558476 discloses a method of producing a plastics bank note or security token or the like comprising a transparent polymeric substrate coated with layers of opaque material applied in such a way as to leave a transparent area which may include an optically variable security device, such as a diffraction grating, on an opaque, reflective layer of foil.

Whilst plastics bank notes with transparent areas including diffraction gratings as optically variable security devices, such as disclosed in Australian Patent No 558476, are difficult to reproduce, in low value plastics bank notes the process of incorporating diffraction gratings in the notes may be too costly or not felt to be needed.

It is therefore desirable to provide a bank note or other security document or token with a simpler, less expensive security device but which is still effective and difficult to reproduce.

It is also desirable to provide a method of, and apparatus for, producing bank notes or other security documents or tokens with low cost security devices that are difficult to reproduce.

It is further desirable to provide a plastics bank note or other security document or token with a security device that produces an optically variable effect when the note, document or token is rotated or viewed from different angles and which gives feel or texture to the note, document or token.

SUMMARY OF THE INVENTION

According to one aspect of the invention there is provided a bank note or other security document or token comprising a substrate having a part bearing printed and a transparent indicia-free portion including a security device wherein said security device comprises an embossing on said transparent portion forming an image which allows light to pass through, the image being visible under reflection and transmission of light from both sides of the bank note or other security document or token.

The embossing is preferably such that when the document is tilted or viewed from different angles with respect to a light source the embossed image will reflect and transmit more or less light as the document is rotated or viewed from different angles. When light passes through the embossing from the light source to the viewer in a direction substantially perpendicular to the surface of the transparent portion of the substrate, the embossed image is almost invisible, and as the viewing angle changes from the perpendicular, the embossed image becomes more highly visible. This gives the effect of the image changing, or switching on or off.

The embossing preferably comprises a regular matrix of embossed lines or dots or the like which together define the image. The embossed image may include one or more embossings deeper than other embossings and/or it may include embossed lines or series of dots extending at different angles to each other.

In a preferred embodiment the embossed image includes a first set of substantially parallel lines and a second set of substantially parallel lines extending at an angle with respect to the first set of parallel lines so that as the document is rotated or viewed from different angles relative to the light source the first set of parallel lines transmit more or less light than the second set of parallel lines.

Alternatively, or additionally, the embossed image may include embossed lines or dots of different depth, width or size so as to introduce different shapes into the image which become more or less evident as the document is rotated or viewed from different angles relative to a light source. Preferably, at least some of the lines, dots or other embossings are of a sufficient depth and/or width to be capable of detection by the naked eye and by touch. In a preferred embodiment of the embossings, the embossings are at least about 10 microns wide and about 10 microns deep.

According to another aspect of the invention there is provided a bank note or other security document or token comprising a substrate bearing indicia, said substrate having a portion of transparent plastics material carrying a security device, said security device comprises an embossed image formed on said transparent portion of plastics material, said embossed image being capable of detection by means of the naked eye and by touch. The embossed image may conveniently comprise a matrix of lines, dots or other embossings Preferably, the matrix of embossings includes one or more embossings deeper and/or wider than the other embossings. In a preferred embodiment, the matrix of embossings includes a first set of fine lines defining at least one shape which is more or less visible as the note, document or token is rotated or viewed from different angles, and a second set of deeper or coarser lines defining a shape which is able to be detected by touch. The fine lines of the preferred embodiment may, for instance, be about 40 microns deep and about 125 microns wide and generally U-shaped in profile, whereas the deeper or coarser lines are typically about 125 microns deep and about 500 microns wide and generally square shaped in profile. The deeper or coarser lines are preferably positioned or configured to provide protection of the other finer embossings against wear during use of the bank note or other security document or token.

Whilst the matrix of embossings are preferably provided wholly within a transparent, indicia-free portion of the bank note, document or token, it is also possible for the matrix of embossings to extend into an opaque area around or adjacent to the transparent portion so as to form a continuous image crossing the boundary between the transparent portion and the opaque area.

According to a further aspect of the invention there is provided a method of producing a bank note or other security document or token comprising the steps of: providing a substrate having at least a portion formed of transparent plastics material, printing indicia onto part of the substrate in such a manner as to leave the transparent portion of the substrate indicia-free, and embossing at least part of the transparent indicia-free portion to form an embossed image which allows light to pass through, the image being visible from both sides of the bank note or other security document or token.

Preferably, the transparent portion is embossed with a matrix of lines, dots or other embossings to define at least one shape that is visible in both reflection and transmission. The lines, dots or other embossings formed by the embossing process preferably produce an image which includes a plurality of different shapes which are more or less apparent as the note, document or token is rotated or viewed from different angles. In the embossing process, the transparent portion is preferably embossed with some lines, dots or embossings of greater depth and/or width than other embossings, and preferably at least the deeper and/or wider embossings are capable of being detected by means of the naked eye and by touch. In a preferred form of the process, the embossings are at least about 10 microns wide and about 10 microns deep.

In a preferred form of the invention, the embossings are formed in the portion of plastics material during the printing of at least part of the indicia onto the note, document or token, and most preferably by using an intaglio method to print said indicia.

The matrix of embossings are preferably formed by applying an embossing plate to the portion of the plastics material under heat and pressure. A convenient embossing temperature may fall substantially within the range from 70 to 85° C., preferably about 80° C., and a convenient embossing pressure may fall substantially within the range 30 to 40 MPa.

The document may be formed entirely from transparent plastics material to which an opaque coating is applied, except in the region defming said transparent portion, the document being subsequently printed onto the opaque coating and embossed on said transparent portion.

The embossings may be provided wholly within a transparent, indicia-free portion of the note, document or token. Alternatively, the opaque area surrounding the transparent, indicia-free portion may also be embossed, preferably so as to form a continuous image crossing the boundary between the clear and opaque areas.

According to a further aspect of the invention there is provided apparatus for producing bank notes or other security documents or tokens with security devices, comprising printing means for applying printed indicia to a plastics substrate having at least a transparent portion, inking means to apply ink to the printing means, and pressure-applying means to press the plastics substrate onto the printing means so that ink from the printing means is transferred as indicia onto the plastics substrate, wherein the inking means and printing means are so constructed and arranged as to leave said transparent portion of said plastics substrate free of indicia, and said apparatus further includes means to emboss at least said transparent, indicia-free portion to form an embossed image which allows light to pass through, the image being visible from both sides of the substrate.

According to a still further aspect of the invention there is provided apparatus for producing bank notes or other security documents or tokens with security devices, comprising printing means for applying printed indicia to a plastics substrate having at least a transparent portion, inking means to apply ink to the printing means, and pressure-applying means to press the plastics substrate onto the printing means so that indicia is transferred from the printing means to the plastics substrate, wherein the inking means and printing means are so constructed and arranged as to leave said transparent portion of said plastics substrate free of indicia, and said apparatus further includes means to emboss a portion of the plastics substrate to form an embossed image on said portion which is able to be detected by the naked eye and by touch. In a preferred embodiment of the apparatus, the means for embossing the portion of the plastics substrate produces embossings that are at least about 10 microns wide and about 10 microns deep.

The means for embossing the portion of the plastics substrate preferably comprises at least one embossing plate which is applied to said portion of the substrate under heat and pressure to produce said embossed image. The embossing plate preferably includes a matrix of engraved lines, dots or other engraved formations which, when applied to said portion of the substrate, produces a corresponding matrix of embossed lines, dots or other formations forming the required image on said portion of the substrate.

Preferably, some of the lines, dots or engraved formations are deeper and/or wider than other lines, dots or engraved formations on the embossing plate, so as to produce embossed lines, dots or other formations of different depths and/or widths on said portion of the substrate. The lines, dots or other formations of different depths and/or widths may form different shapes within the embossed image.

In a preferred embodiment, the embossing plate includes engraved sets of lines extending at different angles and defining different shapes so that the embossed image includes different shapes which become more or less apparent as the bank note or other security document or token is rotated or viewed from different angles.

The embossing plates preferably form part of an intaglio printing press having printing means in the form of a printing plate cylinder and pressure-applying means in the form of an impression cylinder, with substrate feeding means for feeding a transparent plastics substrate to the nip between the printing plate cylinder and the impression cylinder. One or both of the cylinders of the intaglio printing press may have a packing blanket on its external surface made from a compliant material which allows the substrate and engraving to mate perfectly under load and temperature for many impressions.

Preferably, a plurality of engraved embossing plates are incorporated in the peripheral surface of the printing plate cylinder, and the inking means is preferably in the form of an inking roller which is adapted so that ink is not supplied to the portion of the transparent substrate to be embossed, leaving said portion indicia free. A wiping means may also be provided to remove extraneous ink from the printing plate cylinder.

BRIEF DESCRIPTION OF THE DRAWINGS

The various aspects of the present invention will now be described, by way of example only, with reference to the accompanying drawings, in which.

DETAILED DESCRIPTION OF THE PREFERRED EMBODIMENTS

Figure 1:
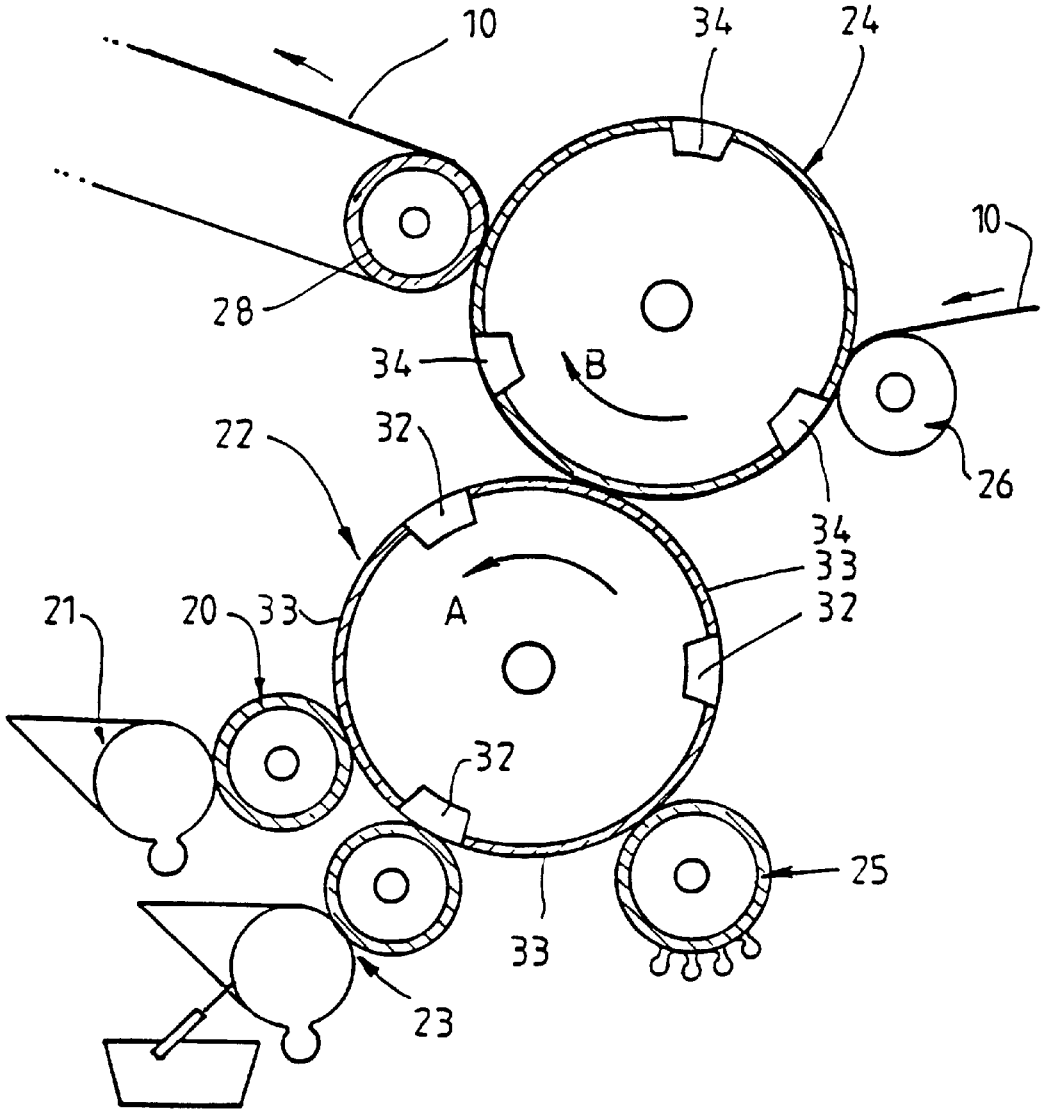
FIG. 1 is a schematic view of apparatus for producing bank notes with security devices thereon in accordance with the invention.

The apparatus shown schematically in FIG. 1 comprises an intaglio printing press comprising an inking roller 20, a plate cylinder 22, an impression cylinder 24 and feed rollers 26 and 28 for feeding a plastics substrate 10 through the nip between the plate cylinder 22 and the impression cylinder 24.

The intaglio method of printing involves special inks being forced into engravings on printing plates 33 of the plate cylinder, 22, each plate comprising a heated nickel chrome printing plate. The ink is supplied via an ink duct 21 and inking roller 20. The printing plate is then wiped by a wiping roller 25 cleaned with either a weak caustic solution or a solvent such as trichloroethylene so that the areas other than the engraving will be free from ink. This polishes the part of the plate flush with the surface to ensure a clean print, and also removes some of the ink from the engraving to allow some embossing to occur. The plate cylinder is then rotated through the nip area under a load of 30 to 40 MPa at 70 to 80° C., depending on the types of inks used. In the nip (FIG. 2) is the substrate 10, the plate with ink and a packing. This packing acts as a compliant material that allows the substrate and engraving plate to mate perfectly under load and temperature for many impressions. This type of process has several advantages: it enables thick film weights of special inks to be used; it provides a high resolution of print; the feel of the finished document is improved because of the ink printing and embossing; and the process is very hard to simulate because of the temperatures and high pressures involved and because the machine itself is only sold to security printers.

The intaglio printing press of FIG. 1 differs from standard intaglio presses in that the plate cylinder 22 includes a plurality of embossing plates 32 provided at spaced intervals in the circumferential surface of the impression cylinder, the embossing or engraving plates being arranged in use, come into register with corresponding pressure plate elements 34 in the circumferential surface of the impression cylinder 22 when the plate and impression cylinders 22 and 24 are rotated in the directions shown by arrows A and B respectively.

The remaining areas 33 of the circumferential surface of the plate cylinder are engraved with printed indicia for bank notes or other security documents in a known manner as with standard intaglio dies and receives ink from the ink duct 21 and the inking roller 20. The indicia is subsequently transferred from the inked surface of the plate cylinder onto one side of the plastics substrate 10 as the substrate passes through the nip between the plate and impression cylinders 22 and 24.

Figure 3:
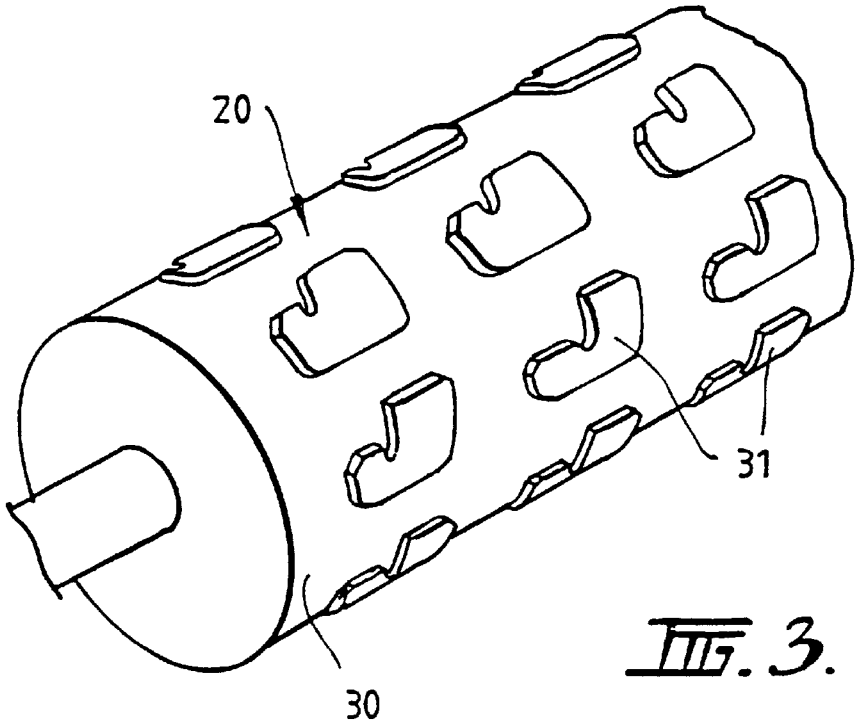
FIG. 3 is a sectional view of the nip between the printing plate cylinder and the impression cylinder of the apparatus of FIG. 1.

In the method of the present invention, the plastics substrate is preferably transparent, or at least has one or more transparent portions, and, as shown in FIG. 3, the surface 30 of the inking roller 20 is cut or formed with ink-receiving formations 31 so that only the areas 33 of the plate cylinder 22 corresponding to the parts of the bank notes or other security documents to be printed with indicia receive ink from the inking roller 20. The embossing plates 32 of the plate cylinder 22 therefore receive little or no ink from the inking roller 20 so that the parts of the substrate 10 which pass through the intaglio press when the embossing plates 32 and the pressure plate elements 34 are in register are free of printed indicia. If required, ink salvage means 23 in the form of a salvage roller and ink reservoir may be provided for receiving excess ink transferred from the inking roller 20 to the plate cylinder 22.

Figure 2:
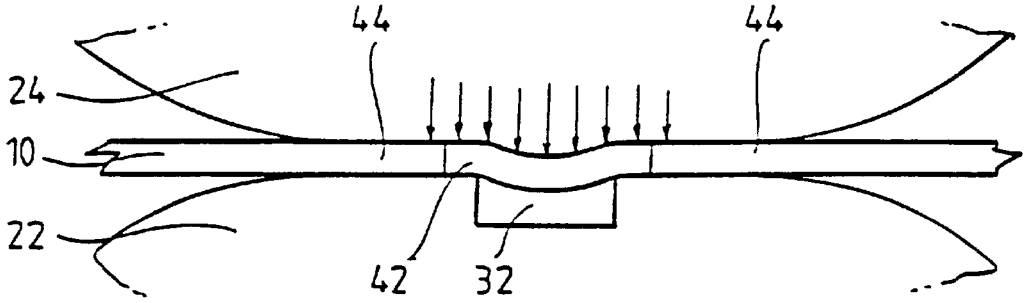
FIG. 2 is an isometric view of an inking roller of the apparatus of FIG. 1.

The embossing plates 32 contain projecting portions and recesses or grooves forming an arrangement or matrix of engraved lines, dots or other engravings, preferably of different depths or sizes so that when the substrate 10 passes through the nip between the plate cylinder and the impression cylinder, as shown in detail in FIG. 2, the indicia-free region 12 of the substrate 10 is embossed with the matrix of lines, dots or other engravings to form a security device on the transparent indicia-free portion which allows light to pass through. The embossed lines, dots or other engravings may be arranged to form an image of any desired shape which is visible from both sides of the bank note or other security document or token, and the direction, width and/or separation of the lines, the size of the dots or other engravings and the depth of the lines, dots or other engravings may vary at different locations of the engraving so as to produce different shapes within an image which transmit more or less light and are more or less apparent as will be described below with reference to FIGS. 4 to 6.

In embossing the security device onto the substrate 10 for the bank note or other security document, the choice of the embossing pressure and temperature is important since if these are not satisfactory, the embossing process could lead to weaknesses in the embossed area and subsequent splitting of the resultant security document, or to the embossed area of the plastics material flowing back towards its original form, thus reducing the effect of the embossing. Thus, in a preferred embodiment, the intaglio press is preferably set to about 80° C. with a 2 mm thick packing of high density paper board (1.5 mm) and a rubber coated cotton blanket surrounding the impression cylinder 24. The plate and impression cylinders are preferably arranged so that the load in the nip is approximately thirty five MPa. If the finished banknote or other security document is to be printed with intaglio printing on both sides then the embossing should be done last on a second pass through the intaglio press so that the embossing will not be affected by the other intaglio printing on the opposite side of the banknote or other security document.

To assist with the prevention of soiling of the document, a protective coating, preferably comprising a thin clear layer of radiation cured material of a dissimilar refractive index to the transparent substrate, may be applied over the embossed security device. The protective coating is preferably such that it will not interfere with the optical properties or the feel of the document in the clear area.

The embossing plates are preferably formed by the following method. First, an engraving is cut into a piece of steel by hand as with normal intaglio dies. This steel die is pressed into plastic, which is then coated with a silver spray solution and then a master plate is grown electrochemically off this plastic replica. Subsequent nickel embossing plates may be grown again electrochemically off this master plate.

The nickel printing plates are then electrochemically deposited with a thin layer of chrome for a good surface finish and to increase the hardness. The chrome finish is important because it is imperative that the high gloss of the clear plastics substrate is maintained and the reflective properties are not reduced.

Figure 5A:
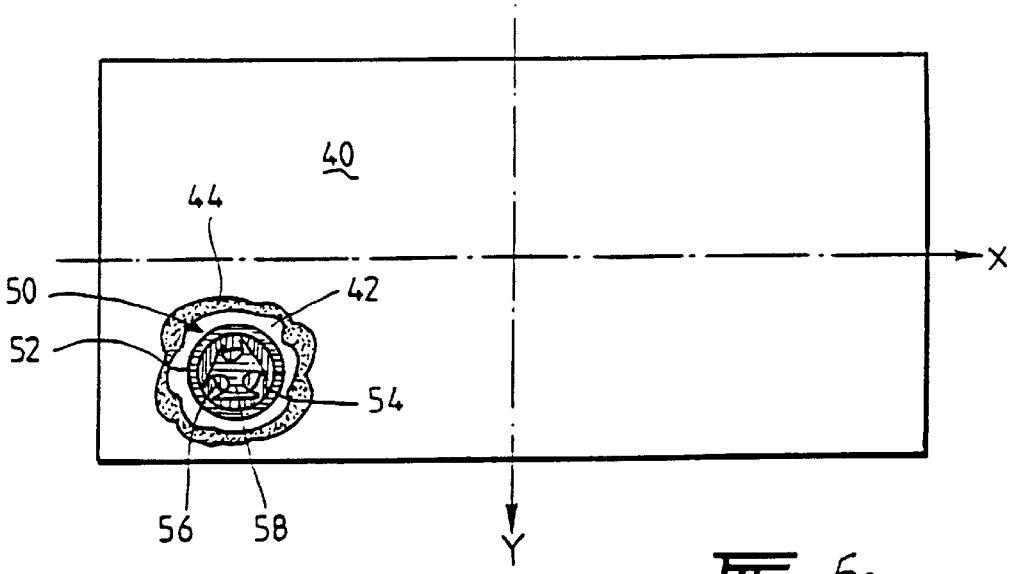
FIGS. 5*a*, 5*b* and 5*c* are views from different angles of a banknote incorporating a security device in accordance with the invention.
Figure 5B:
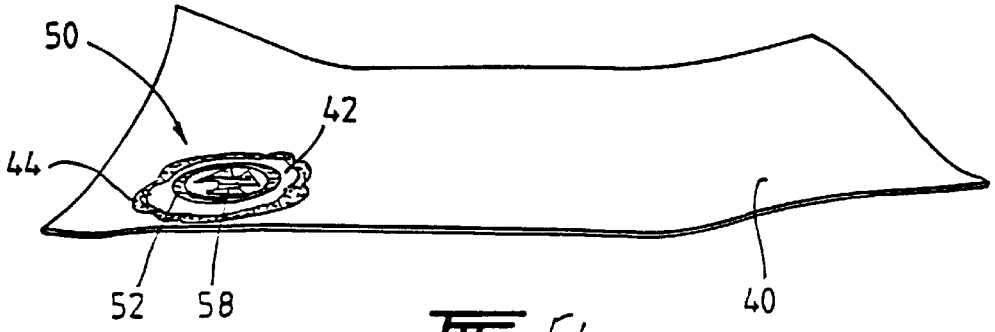
Figure 5C:
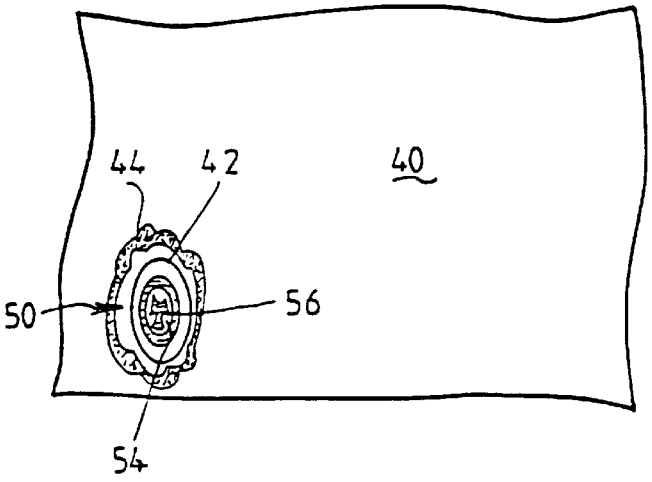
Figure 6:
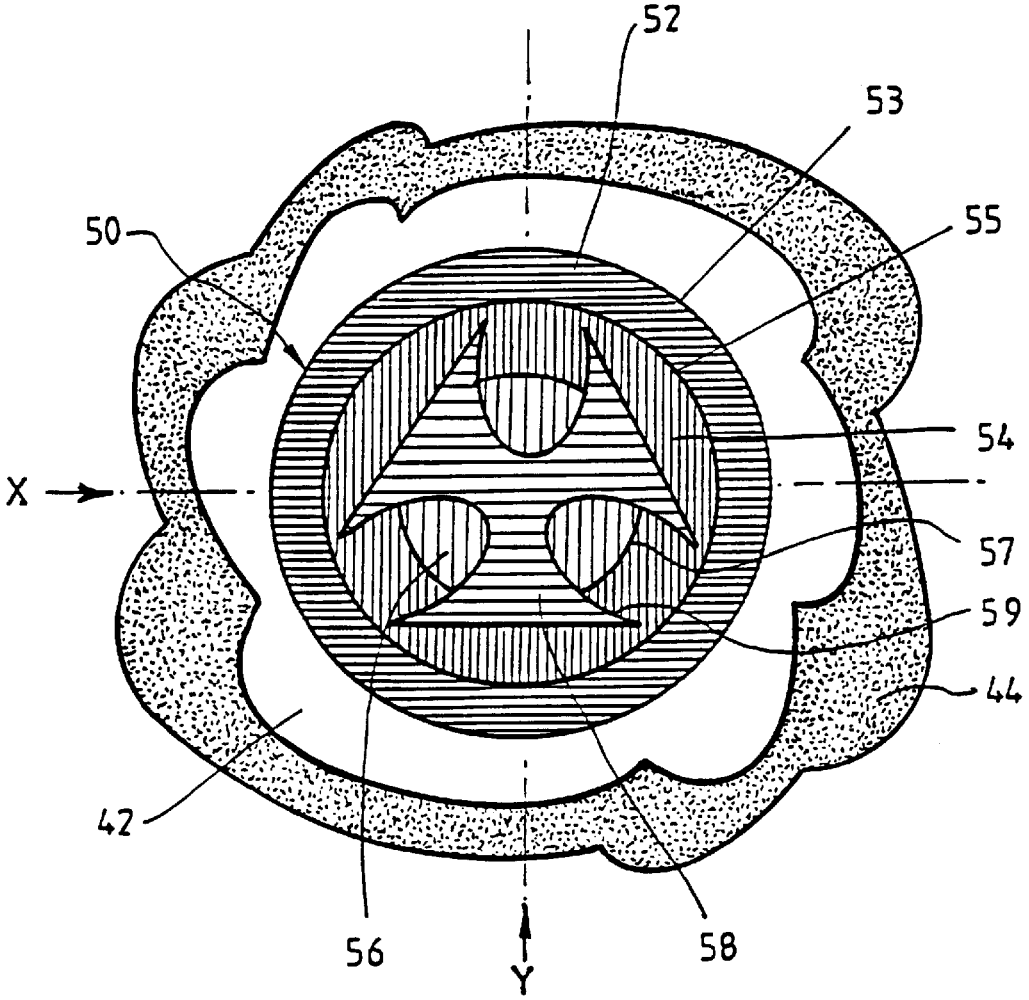
FIG. 6 is an enlarged view of the security device of the banknote of FIG. 4.

An example of a bank note incorporating a preferred form of security device which may be produced by the method and apparatus of the present invention is illustrated in FIGS. 5 and 6 of the drawings, and the manner in which different parts of the device become more or less apparent as the note is rotated or viewed from a different angle relative to a light source will be described with reference to FIGS. 4 and 5.

As shown in FIG. 5, a bank note 40 incorporates a security device 50 embossed onto a transparent portion 42 at one corner of the note. At least the region 44 surrounding the transparent portion 42 is printed with indicia and preferably all of the remaining part of the bank note is printed with indicia. Although the bank note preferably comprises a transparent plastics substrate which is printed with indicia everywhere except the portion 42 where the security device 50 is embossed, it will be appreciated that the banknote may be formed of an opaque material which includes a transparent portion at the required position for the security device.

The security device 50 is shown in greater detail in FIG. 6 and comprises an arrangement of horizontal and vertical embossed lines defining regions 52, 54, 56 and 58 of different shapes which form images that are visible to a greater or lesser extent under reflection and transmission of light.

The region 52 comprises an outer ring including a plurality of fine, closely spaced embossed parallel lines, and the region 54 comprises an inner ring including a plurality of fine, closely spaced parallel lines extending substantially perpendicularly to the lines within region 52. The region 56 is circular in shape and includes a plurality of more widely spaced, fine lines extending parallel to each other and to the lines of the inner ring region 54, and the region 58 is in the shape of a three limbed device superimposed over the inner ring 54 and the circular region 54 and includes a plurality of more widely spaced fine lines extending parallel to each other and to the lines of the outer ring 52. The fine lines of each of the regions 52, 54, 56 and 58 are preferably at least about 10 microns wide and at least 10 microns deep (as such dimensions have been found to define the approximate lower limits of embossings which are detectable by the naked eye and by touch), and they are typically about 40 microns deep and about 125 microns wide and are preferably U-shaped in profile as shown in FIG. 4. The outer parts 53, 55, 57 and 59 of the lines defining the perimeter of the different shaped regions are preferably deeper and coarser than the fine lines to provide a border effect at the perimeter of each shape; they may, for instance, be up to 150 microns deep and up to 500 microns wide and of square-shaped profile. Lines of these depths and widths may be detected by touch in addition to being visible under transmission and reflection.

Figure 4A:
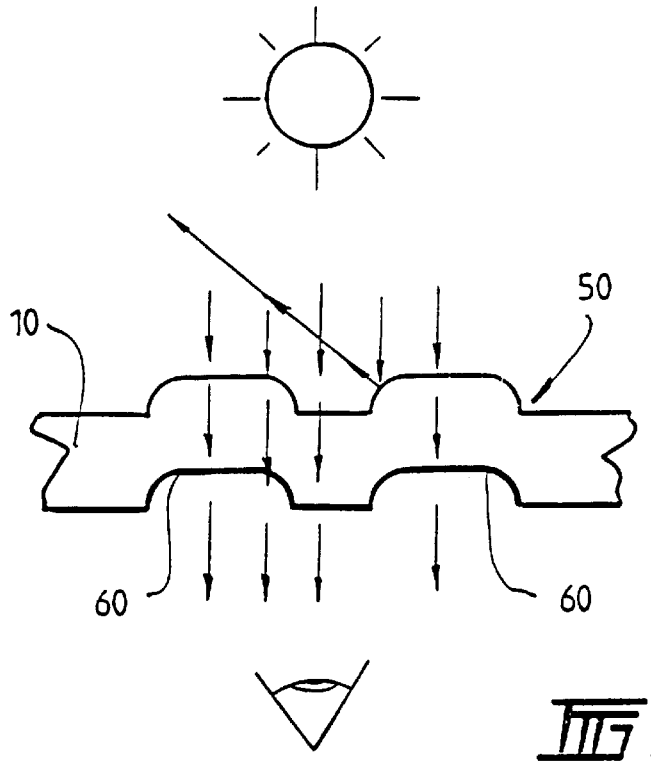
FIGS. 4*a* and 4*b* are an enlarged schematic view of part of a security device in accordance with the invention.
Figure 4B:
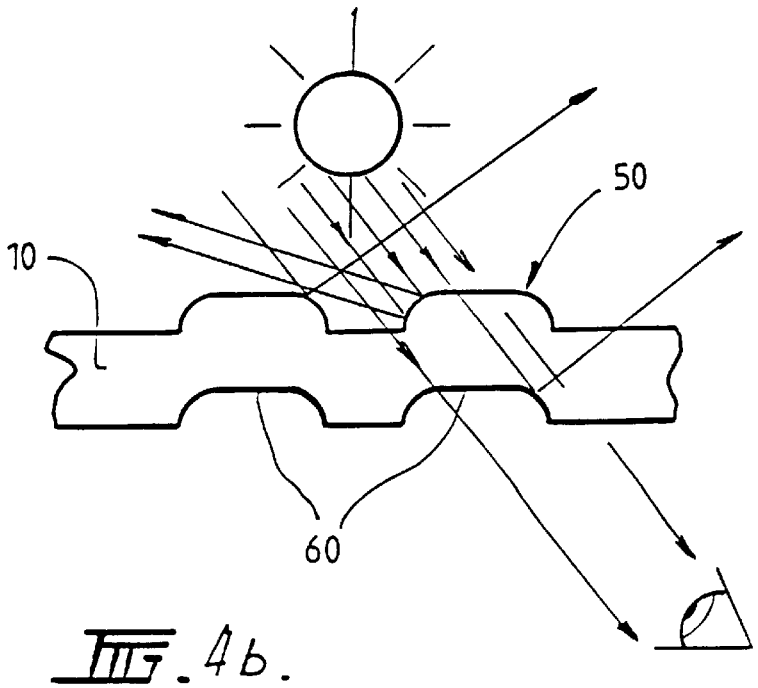

Referring to FIGS. 4*a* and 4*b*, it will be appreciated that when a banknote or other security document including a security device in accordance with the invention is viewed from one side of the document with the light source on the other side, the image or images formed by the embossed lines, dots or other engravings 60, will become more or less apparent if the document is rotated or viewed from a different angle. For instance, as shown in FIG. 4*a*, most of the light rays from the light source will pass directly through the embossed lines 60 of the security device when the surface of the document is substantially perpendicular to the direction in which the light rays pass from the source to the viewer, and consequently the image or images formed by the embossed lines 60 of the security device will not be very apparent.

However, as the document is rotated, or viewed from a different angle (FIG. 4*b*) unless the embossed lines are aligned with the light source and viewer, less light will be transmitted through the lines and more light will be reflected by the edges of the lines 60 and the image formed by those lines will become darker or "switch on".

The "switching on and off" effect where the security device includes different sets of lines extending perpendicularly with respect to each other to define different shapes within the image is further illustrated in FIGS. 5*a*, 5*b* and 5*c*.

Although each of the different shapes, ie. the outer ring 52, the inner ring 54, the circle 56 and the three limbed device 58 is shown in FIG. 5*a*, it will be appreciated that when the device is viewed in transmission with the light rays passing substantially perpendicularly through the security device, only the borders 51, 53, 55 and 57 of the different shapes formed by the deeper lines will be readily apparent. If, however, the document is rotated, about axis X (or an axis parallel thereto) into the position shown in FIG. 5*b*, the shapes 52 and 58 formed by the lines extending parallel to axis X will become more apparent or "switch on", with the outer ring 52 formed by the narrower or more closely spaced lines initially becoming darker than the shape 58 formed by the more widely spaced lines. At the same time, the inner ring shape 54 and the circular shape 56 which are formed by lines aligned with the direction of light transmission will become comparatively less apparent or "switch off".

Conversely, if the document is rotated about axis Y (or an axis parallel thereto) into the position shown in FIG. 5*c*, the shapes 52 and 58 will become comparatively less apparent or "switch off" and the shapes 54 and 56 will become more apparent and "switch on" with the inner ring 54 formed by more closely spaced lines initially becoming darker than the circular shape 56 formed by more widely spaced lines.

From the above description it will be appreciated that the present invention not only provides in its various aspects an improved type of security device which may be detected under transmission as well as reflection, and also by touch, but also an economical method of manufacturing bank notes or other security documents incorporating such security devices, and an apparatus for making such documents.

It will also be appreciated that various modifications may be made to the various forms of security device, method and apparatus disclosed herein without departing from the scope and spirit of the present invention.

What is claimed is:

1. A security document or token comprising a substrate having a part bearing printed indicia and a transparent indicia-free portion of plastics material forming a window through the security document or token, said window including a security device, wherein said security device comprises an embossed image of embossings on said plastics window, said embossed image allowing light to pass through, the embossings of the embossed image being visible to the naked eye under reflection and transmission of light from both sides of the security document or token.

2. A security document or token according to claim 1 wherein the embossings of the embossed image block or transmit different amounts of light when the document is tilted, rotated or viewed from different angles with respect to a light source such that the embossed image reflects and transmits more or less light as it is tilted, rotated or viewed from different angles.

3. A security document or token according to claim 1 wherein the security device comprises a matrix of lines, dots or other embossings.

4. A security document or token according to claim 1 wherein the security device includes at least one embossing that is deeper or wider than other embossings.

5. A security document or token according to claim 1 wherein the security device includes embossed lines or series of dots extending at different angles to each other.

6. A security document or token according to claim 1 wherein the security device includes a first set of substantially parallel lines and a second set of substantially parallel lines extending at an angle relative to the first set of lines, so that as the document is rotated or viewed from different angles relative to a light source, the first set of parallel lines transmit or reflect more or less light than the second set of parallel lines.

7. A security device according to claim 1 wherein the embossings are at least about 10 microns wide and at least about 10 microns deep.

8. A security document or token according to claim 1 wherein the security device includes a first set of fine lines defining at least one shape which becomes more or less visible as the security document or token is rotated or viewed from different angles, and a second set of lines which are deeper and/or coarser than the first set of lines and which define a shape that is able to be detected by touch.

9. A security document or token according to claim 8 wherein the deeper or coarser lines are positioned or configured to provide protection for the fine lines against wear during use of the security document or token.

10. A security document or token according to claim 8 wherein the fine lines are about 40 microns deep and about 125 microns wide.

11. A security document or token according to claim 8 wherein the fine lines are generally U-shaped in profile.

12. A security document or token according to claim 8 wherein the deeper, coarser lines are about 125 microns deep and about 500 microns wide.

13. A security document or token comprising a substrate bearing indicia, said substrate having a transparent indicia-free portion of plastics material forming a window through the security document or token, said window including a security device, said security device comprising an embossed image of embossings on said plastics window, said embossed image allowing light to pass through, wherein when light passes through the embossed image from the light source to the viewer in a direction substantially perpendicular to the surface of the plastics window of the substrate, the embossings are almost invisible, and when the viewing angle changes from the perpendicular, the embossings become more highly visible.

14. A security document or token according to claim 13 wherein the security device comprises a matrix of lines, dots or other embossings.

15. A security document or token according to claim 13 wherein the security device includes at least one embossing that is deeper or wider than other embossings.

16. A security document or token according to claim 13 wherein the security device includes embossed lines or series of dots extending at different angles to each other.

17. A security document or token according to claim 16 wherein the security device includes a first set of substantially parallel lines and a second set of substantially parallel lines extending at an angle relative to the first set of lines, so that as the document is rotated or viewed from different angles relative to a light source, the first set of parallel lines transmit or reflect more or less light than the second set of parallel lines.

18. A security document or token according to claim 13 wherein the embossings are at least about 10 microns wide and at least about 10 microns deep.

19. A security document or token according to claim 13 wherein the security device includes a first set of fine lines defining at least one shape which becomes more or less visible as the security document or token is rotated or viewed from different angles, and a second set of lines which are deeper and/or coarser than the first set of lines and which define a shape that is able to be detected by touch.

20. A security document or token according to claim 19 wherein the deeper or coarser lines are positioned or configured to provide protection for the fine lines against wear during use of the security document or token.

21. A security document or token according to claim 19 wherein the fine lines are about 40 microns deep and about 125 microns wide.

22. A security document or token according to claim 19 wherein the fine lines are generally U-shaped in profile.

23. A security document or token according to claim 19 wherein the deeper, coarser lines are about 125 microns deep and about 500 microns wide.

24. A security document or token comprising a substrate bearing indicia, said substrate having a transparent indicia-free portion of plastics material forming a window through the security document or token, said window including a security device, said security device comprising an embossed image of embossings on said transparent window, said embossed image allowing light to pass through, wherein said embossed image on said plastics window is capable of being detected by means of the naked eye and by touch.

25. A security document or token according to claim 24 wherein the security device comprises a matrix of lines, dots or other embossings.

26. A security document or token according to claim 24 wherein the security device includes at least one embossing that is deeper or wider than other embossings.

27. A security document or token according to claim 24 wherein the security device includes embossed lines or series of dots extending at different angles to each other.

28. A security document or token according to claim 27 wherein the security device includes a first set of substantially parallel lines and a second set of substantially parallel lines extending at an angle relative to the first set of lines, so that as the document is rotated or viewed from different angles relative to a light source, the first set of parallel lines transmit or reflect more or less light than the second set of parallel lines.

29. A security document or token according to claim 24 wherein the embossings are at least about 10 microns wide and at least about 10 microns deep.

30. A security document or token according to claim 24 wherein the security device includes a first set of fine lines defining at least one shape which becomes more or less visible as the security document or token is rotated or viewed from different angles, and a second set of lines which are deeper and/or coarser than the first set of lines and which define a shape that is able to be detected by touch.

31. A security document or token according to claim 29 wherein the deeper or coarser lines are positioned or configured to provide protection for the fine lines against wear during use of the security document or token.

32. A security document or token according to claim 29 wherein the fine lines are about 40 microns deep and about 125 microns wide.

33. A security document or token according to claim 29 wherein the fine lines are generally U-shaped in profile.

34. A security document or token according to claim 29 wherein the deeper, coarser lines are about 125 microns deep and about 500 microns wide.

* * * * *